US006604813B2

(12) United States Patent
Green

(10) Patent No.: US 6,604,813 B2
(45) Date of Patent: Aug. 12, 2003

(54) LOW DEBRIS FLUID JETTING SYSTEM

(75) Inventor: Ronald L. Green, Danbury, CT (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 09/900,659

(22) Filed: Jul. 6, 2001

(65) Prior Publication Data

US 2003/0016267 A1 Jan. 23, 2003

(51) Int. Cl.[7] ..... B41J 2/16
(52) U.S. Cl. ..... 347/47; 347/25; 347/40
(58) Field of Search ..... 347/25, 40, 12, 347/47

(56) References Cited

U.S. PATENT DOCUMENTS

| | | | | |
|---|---|---|---|---|
| 3,823,408 A | | 7/1974 | Gordon, III | |
| 4,429,317 A | | 1/1984 | Umezawa et al. | |
| 4,542,389 A | | 9/1985 | Allen | |
| 4,613,875 A | | 9/1986 | Le et al. | |
| 4,728,392 A | | 3/1988 | Miura et al. | |
| 4,801,955 A | | 1/1989 | Miura et al. | |
| 4,947,184 A | | 8/1990 | Moynihan | |
| 4,970,535 A | * | 11/1990 | Oswald et al. | 347/25 |
| 5,225,017 A | | 7/1993 | Ni | |
| 5,287,126 A | * | 2/1994 | Quate | 347/25 |
| 5,790,150 A | | 8/1998 | Lidke et al. | |
| 5,790,151 A | | 8/1998 | Mills | |
| 5,856,836 A | | 1/1999 | Silverbrook | |
| 5,880,759 A | | 3/1999 | Silverbrook | |
| 5,892,524 A | | 4/1999 | Silverbrook | |
| 6,209,991 B1 | | 4/2001 | Regan et al. | |
| 6,217,153 B1 | | 4/2001 | Silverbrook | |

* cited by examiner

*Primary Examiner*—Lamson Nguyen
(74) *Attorney, Agent, or Firm*—Stroock & Stroock & Lavan LLP

(57) ABSTRACT

An improved fluid jet device and method of keeping a fluid jet head clean are provided. The face of the fluid jet head includes one or more orifices, through which fluid is jetted. The orifices are formed through convex ridges at the surface of head. In a preferred embodiment of the invention, the slope from the face to the orifice is either generally constant or decreasing, to provide the convex shape. In an embodiment of the invention, air is blown over the ridge and over the orifice, to keep dust and debris away from the orifice. The flow of air, the shape of the ridge and the proximity of material on which printing occurs can be constructed and arranged to provide laminar flow of air or other gas over the orifice. The downstream side of the ridge from the orifice can have a shallower slope than the upstream side. A vacuum port can be provided on the downstream side.

23 Claims, 5 Drawing Sheets

LOW DEBRIS FLUID JETTING SYSTEM

BACKGROUND OF INVENTION

The invention relates generally to fluid jetting systems and more particularly to constructions of jet heads that are easier to keep free of dust and other debris. An example of a fluid jet head in accordance with the invention is the print head of an ink jet printer.

Ink jet printers produce images on a substrate by ejecting ink drops unto the substrate in order to generate characters or images. Certain ink jet printers are of the "continuous" type where drops are ink of continuously jetted through an orifice of a print head in a charged state. The charged droplets of ink are then electrostatically directed onto the substrate when printing is desired and into a gutter when printing is not required. Another type of an ink jet printer is "on demand" type ink jet printer. Drops of ink are selectively jetted through an orifice of a print head when printing is desired and not jetted when no printing is desired.

An ink storage chamber is commonly connected, via an ink flow passageway, to the print head, to provide a constant flow of ink to the head of the printer. Proper ink jetting generally involves capillary action between the ink and passageways in the ink jet head to position ink at the proper location in the head for proper jetting and drop formation. Thus, high pressure outside the print head can undesirably force ink back into the head, whereas low pressure outside the print head can undesirable draw ink out of the head. Build-up of material in the ink passageway can affect surface tension interactions and disrupt proper operation.

Thus if debris accumulates at surfaces of the ink jet orifices through which ink drops are jetted, ink can undesirably soak into the debris and undesirably accumulate and cause additional debris to be trapped at the orifice. This can alter the surface wetting properties at the orifice and inhibit proper ink droplet formation. Under extreme conditions, the build-up of debris can clog the orifice and prevent printing or lead to interrupted printing and/or streaking.

Certain ink jet printers can be used for high speed, high volume applications, such as canceling checks or postmarking mail, in which of tens of thousands or hundreds of thousands of pieces are passed by the print head in printing session. It will readily be appreciated that printing such a large volume of pieces will generate a considerable amount of dust and debris as the pieces are transported, in close proximity, past the print head.

Many ink jet heads are constructed to require purging, wiping and/or cleaning processes, to keep the orifices sufficiently clean. However, this can be an undesirable task. It also slows down and/or interrupts production.

U.S. Pat. No. 6,196,657, the contents of which are incorporated herein by reference, describes multi-fluidic cleaning for an ink jet print head. In certain embodiments of the invention, liquid cleaning solutions, such as alcohols or acids are used to clean the face of the print head.

It has also been proposed to blow and/or vacuum air over the print head surface to remove debris and liquid ink from the face of the print head. For example, manifold plates have been etched or formed with sheet metal to create vacuum ports and fins to direct air and vacuum across the print head orifices. This has been proposed in connection with flat-face print head and those in which the orifice is surrounded by a raised step structure. However, the designs have not proved to be fully satisfactory both in terms of effectiveness complexity of construction and durability.

Accordingly, it is desirable to provide an improved fluid jet head that is more easily kept free of debris or to otherwise overcome drawbacks of the prior art.

SUMMARY OF THE INVENTION

Generally speaking, in accordance with the invention, an improved fluid jet device and method of keeping a fluid jet head clean are provided. The face of the fluid jet head includes one or more orifices, through which fluid is jetted. The orifices are formed through convex ridges at the surface of head. In a preferred embodiment of the invention, the slope of the ridge from the orifice to the face is either generally constant or increasing, to provide the convex shaped ridge. In an embodiment of the invention, air is blown over the ridge and over the orifice, to keep dust and debris away from the orifice. The flow of air, the shape of the ridge and the proximity of material on which printing occurs can be constructed and arranged to provide laminar flow of air or other gas over the orifice. The downstream side of the ridge from the orifice can have a shallower slope than the upstream side. A vacuum port can be provided on the downstream side.

Accordingly, it is an object of the invention to provide an improved fluid jet head and method of keeping a fluid jet head clean, which overcomes drawbacks of prior systems.

The invention accordingly comprises the features of construction, combinations of elements, arrangements of parts and methods of operation, which will be exemplified in the constructions and methods hereinafter set forth, and the scope of the invention will be indicated in the claims.

BRIEF DESCRIPTION OF THE DRAWINGS

For a fuller understanding of the invention, reference is had to the following description, taken in connection with the accompanying drawings, in which.

DETAILED DESCRIPTION OF THE PREFERRED EMBODIMENTS

Figure 1:
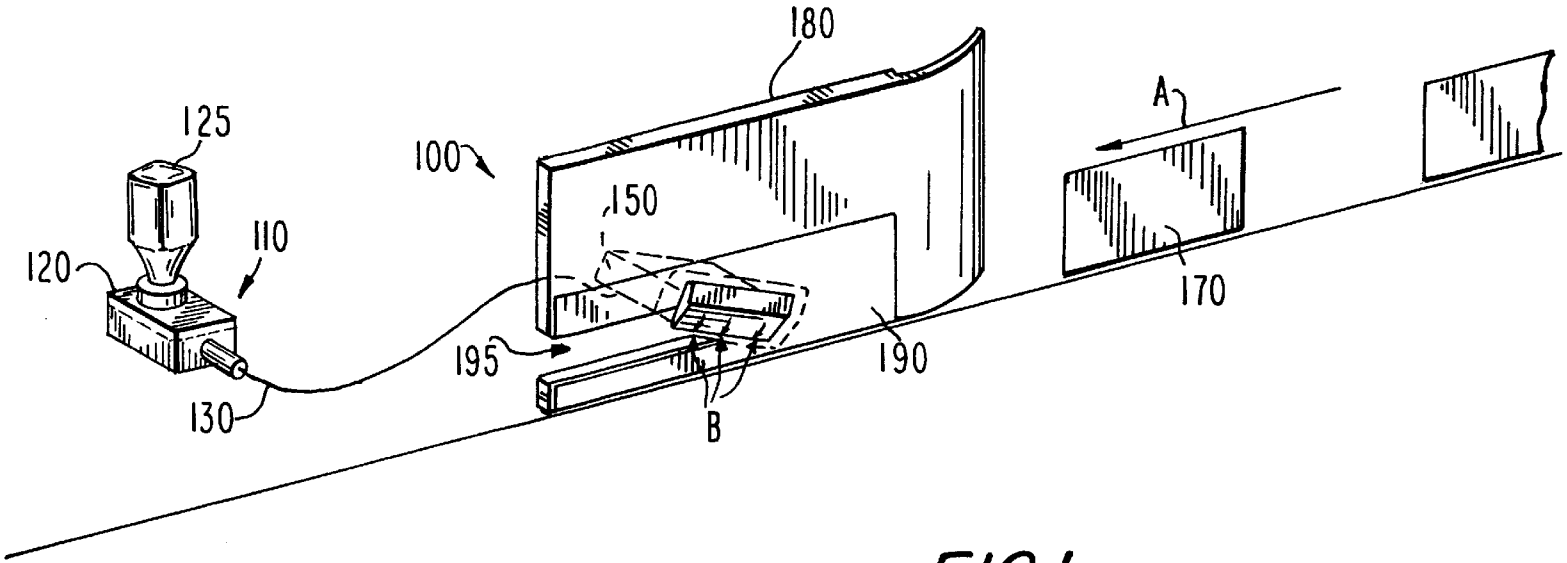
FIG. 1 is a schematic perspective view of a fluid jetting systems in accordance with a preferred embodiment of the invention.

A fluid jetting system in accordance with a preferred embodiment of the invention is shown generally as printing system 100 in FIG. 1. Printing system 100 includes a printer 110, comprising an ink reservoir 120 coupled to an ink tank 125. Ink flows to an ink feed line 130 to a print head 150 for jetting onto a piece of mail 170 traveling in the direction of an arrow A. In one embodiment of the invention, the mail is traveling at a rate of 30 inches/sec.

As will be apparent to those of ordinary skill in the art, system 100 can be used to print on various different types of substrates traveling at various different speeds. As piece of mail 170 travels towards print head 150, it is guided into position by a face plate 180 and a paper guard 190. In one embodiment of the invention, paper guard 190 is 0.010 inches thick. Typical face guards are generally 0.003 to 0.20 inches thick. Paper guard 190 includes an air relief slot 195, which is also cut into face plate 180.

Air relief slot 195 is provided to help ensure that 1) air pressure locally around the orifices holes does not differ significantly from atmospheric pressure, 2) solvent vapors from the ink cannot build up around the printhead and cause wetting issues with the front surface of the orifice plate, 3) paper dust fibers are not trapped on any pockets on the face plate, 4) the mailpiece can draft more air immediately adjacent to the plate and better maintain the laminar airflow across the plate, 5) any local pressure build-ups from conditions such as a long mailpiece or a machine stoppage with the air left on are presented, 6) clearance so that the wet ink of the label material does not get smeared by rubbing, 7) a mechanical relief for convex mail pieces or mail pieces with a folded or damaged leading edge mail that would otherwise be pushed out by the face plate after the printhead (if it was there) causing a greater printgap around the printhead and adversely affecting the print quality is provided, 8) mechanical relief for a curled up or loose label is provided, and 9) label adhesive does not build up on that surface causing additional mail feeding problems.

Figure 2:
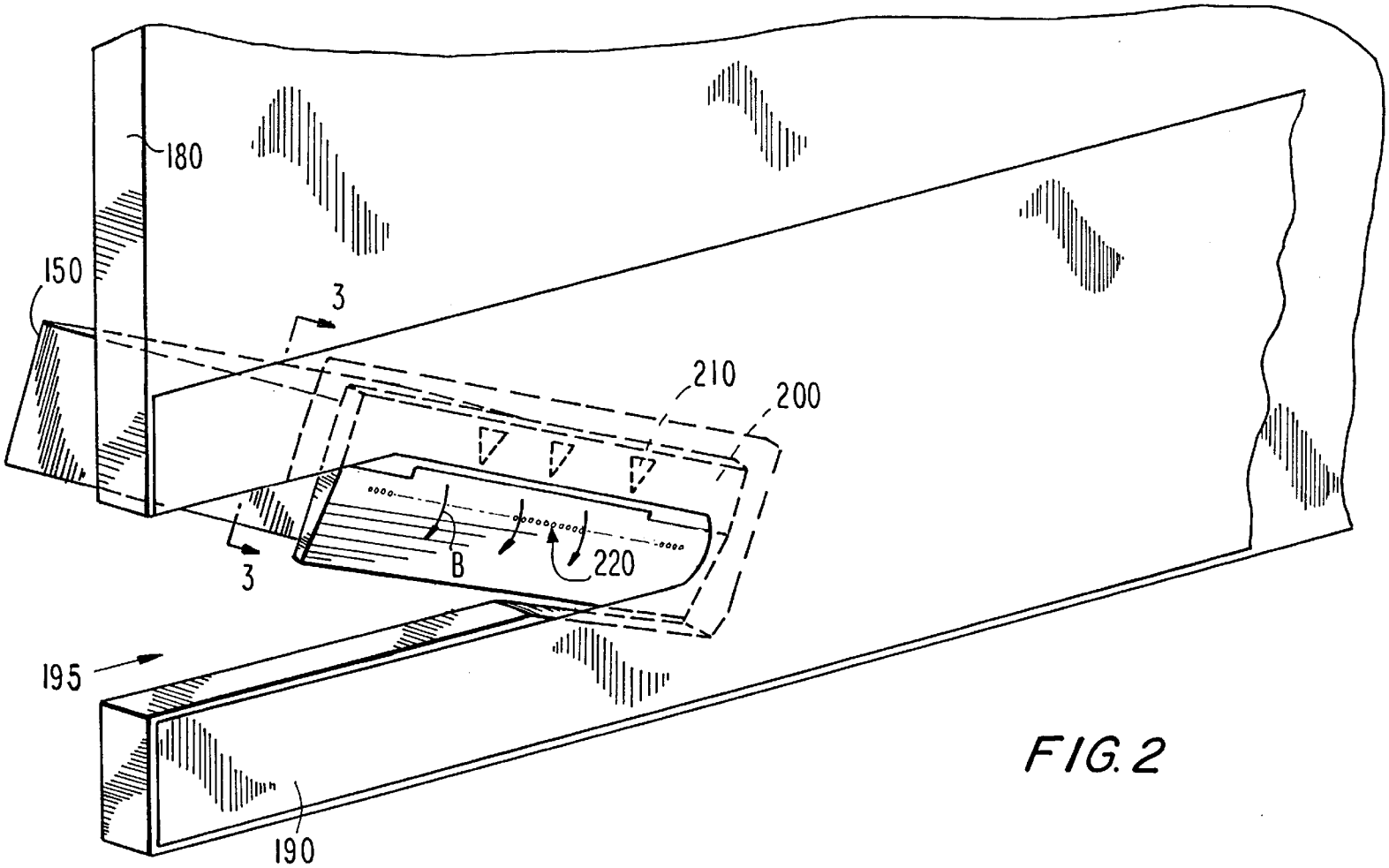
FIG. 2 is an enlarged view of portion 2 of the system of FIG. 1, showing a fluid jet head in accordance with a preferred embodiment of the invention, not necessarily drawn to scale.

Referring to FIG. 2, the enlarged portion of detail "2" of print head 150 of FIG. 1, print head 150 is shown having an orifice plate 200, having a plurality of orifices 220 disposed therethrough. Orifice plates in accordance with different embodiments of the invention can be formed with one or more orifices, formed as either a single row, a double row or a staggered row, depending on the intended use. Lines of 16–128, commonly 32–64 orifices are frequently employed. In a preferred embodiment of the invention, there are about 70 to 140 orifices per inch. Each orifice advantageously has an inner diameter of about 0.0013 to 0.024 inches and a pitch of about 0.004 to 0.015 inches. In one embodiment of the invention, the orifice has an ID of about 0.002 inches. The orifice openings are advantageously coated with a material that will repel ink, such as various silicone surface treatment agents, so as to promote proper drop formation and prevent ink from accumulating at the outer surface of the orifice plate. Acceptable examples include 0.0002–0.0005 inches thick coatings of Nedox SF-2 process, General Magneplate Corp.

Print head 200 also includes the plurality of spacers 210. The spacers can provide the function of 1) mechanically isolating the printhead orifice plate from the shock and vibration of mail hitting the paper guards. If unchecked, this could create ink meniscus disruption and subsequent depriming inside the orifices holes during the jetting and recovery cycles of the printing cycle, 2) thermal insolation from heating due to the friction of the mail rubbing on the paper guards and belts rubbing on the face plate, also thermal isolation from the face plate drawing heat from the printhead through conduction (the printheads are commonly temperature controlled, typically within 2° C. of the desired operating temperature), 3) allow fresh air to be drawn past the printhead face from parasitic drag of the mail and positive air drafting effects, both of which help to keep solvent vapors down to a minimum to yield better non-wetting orifice plate characteristics, 4) prevent an ink drop from bridging the gap between the orifice plate and the paper guard (failure to do so would cause a heat transfer problem from conduction through the ink), 5) mechanically stand the paper guard off of the orifice plate so that mail would not get close enough to the orifice holes to force paper fibers into orifice holes or create a meniscus disruption from mail actually touching the meniscus surface. These spacers are undesirable from the viewpoint that the paper to printhead gap is increased with a corresponding lowering of the print quality. However, this can in part be overcome through use of a bulging orifice plate, where the spacers are below the top of the orifice.

Figure 3:
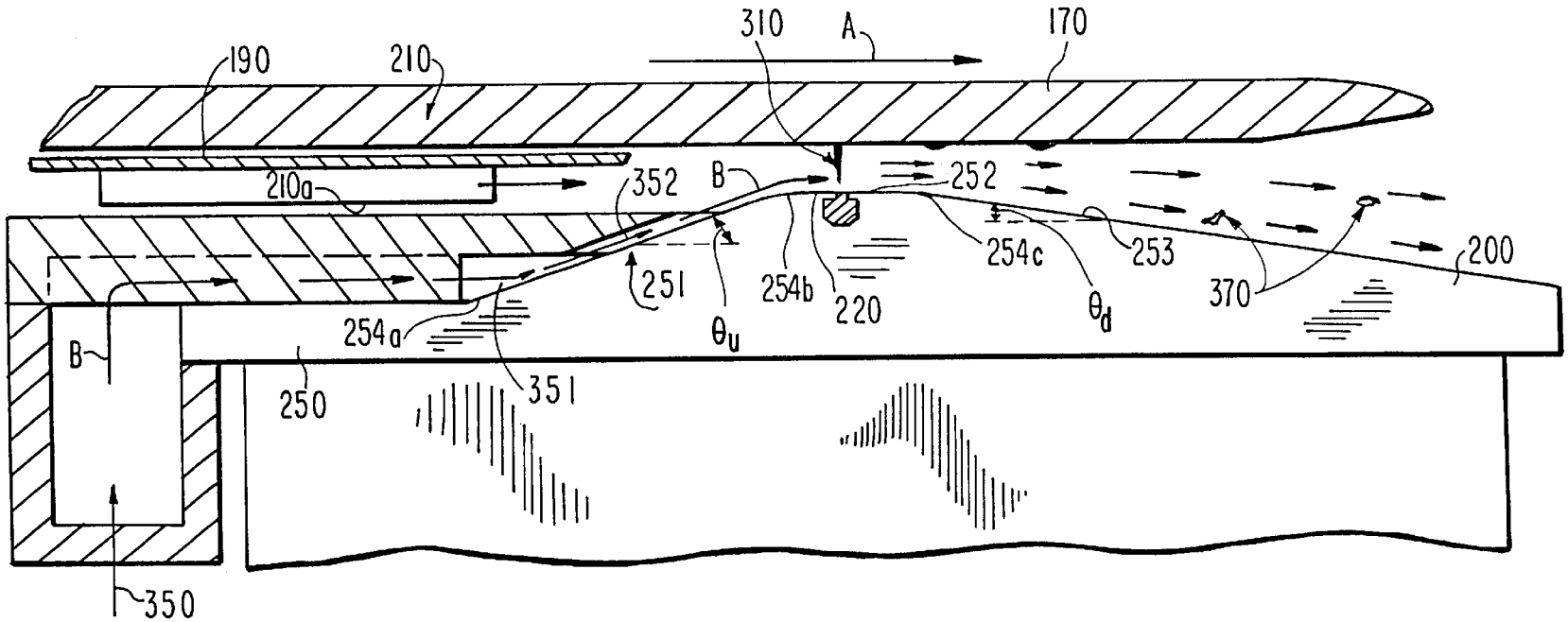
FIG. 3 is a schematic cross-sectional view of the head of FIG. 2, taken along line 3—3.
Figure 4:
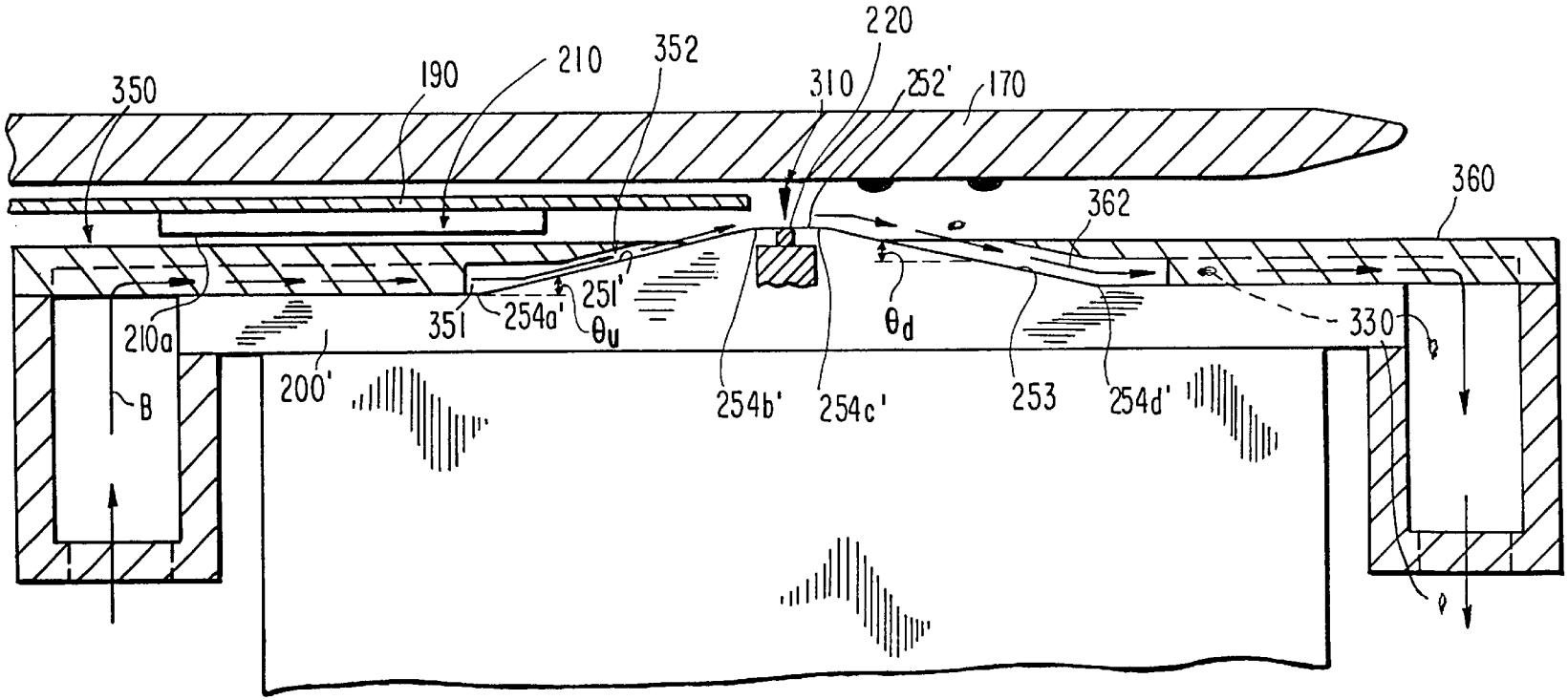
FIG. 4 is a cross-sectional view along line 3—3 of a head of FIG. 2 in accordance with another embodiment of the invention.
Figure 7:
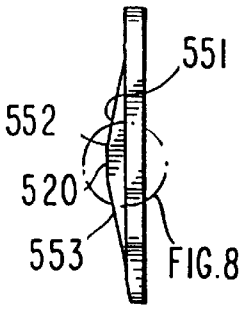
FIG. 7 is a side end view of the print head structure of FIG. 5.
Figure 8:
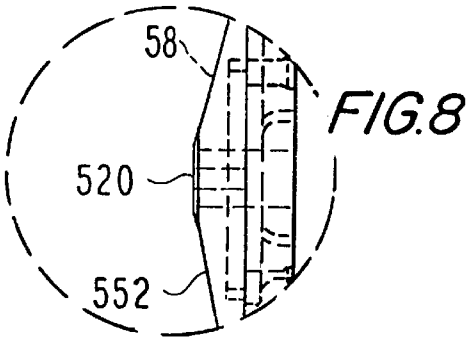
FIG. 8 is an enlarged side end view of region 8 of the print head structure of FIG. 7.
Figure 6:
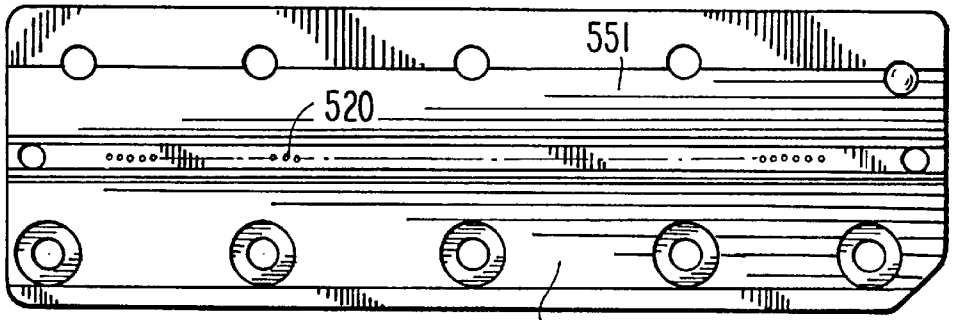
FIG. 6 is a top plan view of the print head structure of FIG. 5.
Figure 5:
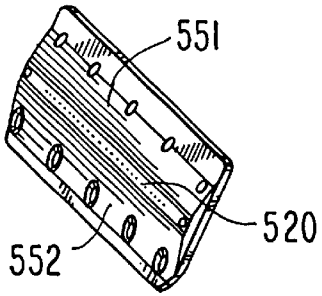
FIG. 5 is a perspective view of an ink jet head orifice plate in accordance with an embodiment of the invention.

The configuration of print head 150 and the operation of the orifice cleaning system and method in accordance with preferred embodiments of the invention can be more clearly understood with reference to FIGS. 3 and 4. FIG. 3 shows orifice plate 200 having a plurality of orifices 220 therein.

Orifice plate 200 includes a base region 250, an upstream slope 251, an orifice region 252 at the top of a ridge, substantially normal to orifice 220 and a downstream slope 253. As used herein, upstream refers to the side of orifice plate 200 facing the source of the air and downstream refers to the side away from the source of the air. In the embodiment of the invention shown in FIG. 3, base area 250 deflects outwards (upwards) to upstream slope 251 at a transition region 254*a*. It was determined to be advantageous to prevent dead areas, eddies, back currents and areas of turbulence from forming, as these can become places where dust and fibers can become trapped. Accordingly, it is advantageous that transition region 254*a* and/or the angle of upstream slope 251 be gradual. Thus, the surface of orifice plate 200 is directed in a gradual declining angle $\theta_u$ on the upstream side of orifice 220, from a plane normal to orifice 220 and at a gradual declining angle $\theta_d$ on the downstream side of orifice 220. The embodiment of the invention shown in FIG. 4 has a substantially uniform upstream and downstream slope $\theta_u \approx \theta_d$. $\theta_u$ and $\theta_d$ should be less than about 45°, preferably about 30 to 5°.

Thus, upstream slope 251 should form an acute angle with orifice region 252 of $\theta_u$ less than about 45°, preferably about 30° to 5° more preferably 20° to 10°. In one preferred embodiment, $\theta_u$ is about 15° and the corner at transition region 254*b* is smooth.

Upstream slope 251 is advantageously substantially flat, having a substantially constant slope or a decreasing slope to form a convex ridge to promote the laminar flow of air over orifice region 252. At an upstream top transition point 254*b* slope 251 flattens out with respect to the intended printing surface, at orifice region 252. Orifice region 252 then transforms downward at upper downstream transition point 254*c*. In the embodiment of the invention shown in FIG. 3, this angle is more gradual than the angle at upstream transition point 254*b*. Downstream slope 253 should be less than about 45° from a line normal to orifice 220 and $\theta_d$ is advantageously about 30° to about 5°, more preferably about 15° to about 5°. In one preferred embodiment, $\theta_d$ is about 10°.

FIGS. 3 and 4 show a drop of ink 310 being ejected from orifice 220 onto mail piece 170, which travels in the direction of arrow A, with paper guard 190 and spacer 210 separating mail piece 170 from orifice 220 to a predefined distance. It should be noted that as the distance between mail piece 170 and orifice 220 decreases, printing precision and quality can be increased. Preferred printing gaps are 0.005 inches or less, more preferably less than 0.003 or 0.002 inches.

Print head 150 is also provided with an air manifold 350 for providing positive air flow in the direction of arrows B. Air flows through air manifold 350 to an air balancing manifold 351 to a vaneless air feed slot 352. Air feed slot 352 is preferably along the entire row of orifices 220. After exiting vaneless air feed slot 352, air blows over orifice region 252 of plate 200 and can blow a plurality of dust and debris particles 370 away from orifice opening 220.

It has been found that constructing system 100 such that there is laminar air flow between mail piece 170 and orifice plate 200, particularly at orifice region 252, provides the most advantageous results in terms of keeping orifice 220 and surrounding areas clean.

Referring to FIG. 4, a printing system in accordance with another preferred embodiment of the invention is shown for ejecting a drop of ink 310 onto a mail piece 170 traveling in a direction of arrow A past paper guard 190 and spacer 210, as in FIG. 3. Air manifold 350 is also present to blow air over orifice 220, as in the embodiment shown in FIG. 3. However, in this embodiment of the invention, a vacuum manifold 360 is provided to suck air dust and ink particles 360 into a vaneless vacuum slot 362, to be disposed of.

An orifice plate 200' is shown with a lower upstream transition region 254*a*', an upstream slope 251', an upper upstream transition region 254*b*', an orifice region 252', an upper downstream transition region 254*c*' and a lower downstream transition region 254*d*. Transition regions 254*a*' and 254*b*' as well as upstream slope 251' can be similar to elements 254*a*, 254*b* and 251 of FIG. 3. It can also be seen that in this embodiment of the invention, the angle at transition regions 254*a*' and 254*d*' as well as at transition regions 254*b*' and 254*c*' are substantially equal.

It should be noted that these angles do not have to be equal, nor do the angles of the embodiment of the invention shown in FIG. 3 have to be as indicated therein. It should also be noted that the indication of upper or lower is merely for reference to the figures, as the print head can be constructed in a position to eject ink upwards, downwards, to the side or any angle therebetween.

The gauge pressure blowing air through pressure manifold 350 can be adjusted as desired, and is advantageously up to about 50 psi. Pressures in the range of about 1 psi to about 30 psi, more preferably about 3 psi to about 20 psi are preferred. Vacuum manifold 360 can be operated with various levels of vacuum, depending on the structure and configuration of the system and the specific application. Generally, vacuums less than about 29.9 inches of Hg should be used, preferably less than 25 inches Hg, advantageously in the range of about 1 inch to about 20 inches Hg.

An advantage of disposing orifice 220 on a raised ridge is that spacers 210 can be positioned to extend closer to the print head than a boundary bordered by a plane normal to orifice 220. Thus, as shown in FIGS. 3 and 4, a bottom surface 210*a* of spacer 210 extends below orifice regions 220 and 220'. Also, as discussed above, the manifolds 350 and 360 can be entirely on the print head side of this plane. Therefore, orifice 220 can be closer to the print substrate than the air vents and pressure manifolds.

Referring to FIGS. 5–8, a print head orifice plate 500 is shown, drawn to scale, having a plurality of orifices 520, an upstream slope 551 and a downstream slope 552 is shown. Upstream slope 551 forms an angle of about 10° with an orifice region 552. Downstream slope 553 forms an angle of about 15° with orifice region 552.

A print head in accordance with the invention having an outer surface with a portion sloping downwards from the orifice, at an angle to an air vent can be constructed to permit air to flow across the orifice plate without the use of vanes or entrance or exit edges. This helps prevent eddy currents and dead air zones from occurring. Printing systems can also be constructed to prevent turbulent air flow from occurring in the area of the printing orifices. Vanes, corners, sharp edges, eddy currents, dead air zone and turbulence can all lead to the build up of dust and fibers. Designs in accordance with the invention can position the entire positive air manifold below the surface of the orifice, flush with the orifice plate surface. This leads to smaller printing gaps and adequate separation of the print head and substrate to be printed.

By employing a combination of pressure and/or vacuum and a smooth curved surface, preferably convex in shape, constructions in accordance with the invention can clean the fluid jetting surface that are not directly in front of the air passages. This provides for cleaning blind surfaces. The air manifolds are advantageously constructed as a relatively thick section, which can improve durability over thin sheet metal constructions. Constructions in accordance with the invention can also be provided in which the screws which connect the various portions of the print head can remain exposed. This facilitates construction and maintenance.

Providing the print head surface with a gradually sloping downstream side can permit laminar flow from the pressure manifold without the use of a vacuum port. This decreases the possibility of creating pressure fluctuations that can lead to undesirable results, such as deprimeing the fluid jets by forcing air into orifice holes.

In one embodiment of the invention, an anti-wetting coating, such as various silicone based wetting coatings such as pure silicone lubricant, silicone grease, commercial fabric silicone based water repellant spray and so forth are applied to the print head surface and/or the orifice surface. The flow of air over the orifice also increases evaporation rates, such that ink or solvent traces can evaporate more fully, reducing any trend for ink to wet and creep along the surface of the print head. Print heads in accordance with the invention can continue printing in dusty environments for extended time periods, such as printing sessions in which 100,000 or more envelopes are printed. Constructions in accordance with the invention have additional advantages, in that the flush, forward position of the pressure manifold is protected from being struck by "fat" pieces of mail or other printing surfaces, leading to a design that is more durable than a constructions in which raised thin sheet metal manifolds and tins are used. Print heads in accordance with the invention can be used to mark checks, mail and other high speeds operations without printing degrading from the accumulation of dust and/or paper fibers.

In a preferred embodiment of the invention, the shape of the bulge can be roughly approximated by the top surface of an airfoil. For an airfoil, the separation point for a laminar flow can be predicted using the Faulkner-Skan theoretical equation and a numerical solution, pages 139–151 of *Aerodynamics For Engineers,* Bertin and Smith, 1979, Prentice Hall, incorporated by reference. Because of the close proximity of the mail piece, the airfoil approximation might only be valid during the absence of a mailpiece. When a mailpiece is present, the flow field changes (as measured experimentally) and the use of a similar airfoil section is not necessarily valid because the separation data was derived using an infinite sized flow field.

In one preferred embodiment of the invention, airflow velocity (V) will be laminar and will substantially equal $h^2\Delta p/12\ \mu L$, where h is equal to the height of the air slot, L is its length, $\mu$ is the viscosity of air and $\Delta p$ is the pressure differential causing the airflow.

It has been determined that in one embodiment of the invention, the air flow is about 4.5 m/s at its peak at the end of the orifice plate in open air. With the reduction of air velocity to about 1 m/s when a stationary envelope is present, and the knowledge that the envelope typically moves at 3 m/s, it would appear that an airflow is present across the face of the printhead of around 3–4 m/s. From the theory of the dust collector systems, the use of the two radii and sloped surfaces would create a local radial airflow with would tend to force the air flow to make a 25–30° bend around surface with approximately 0.231 in R. The radial acceleration forces would exert a g force on a dust particle of about 278 g's if the dust particle was caught in that air stream.

Using the above criteria for the shape of the bulge, the bulge: 1) should be large enough and gentle enough in slope change to not let the air flow separate from 'going around the bend', 2) should be sharp enough to have a significant radial acceleration component to throw the dust and debris away from the printhead, 3) the airflow speed should substantially match the substrate transport speed reasonably well (this was found useful to keep the tails of the ink drops from separating from the head drops to maintain reasonable print quality, 4) the air flow manifold exit would need to be reasonably close to the edge of the bend to not affect (through viscous forces between the orifice plate and the air) the speed and inertia of the air before it makes the bend around the bulge.

It has been determined that measuring the velocity gradient from the air flow slot to the end of the orifice plate can help to determine if separation will occur and lead to dead zones. Thus, if too great a decrease in velocity occurs, dead zones are likely to develop.

The following relationship shown in Table 1 was also determined between print gap and substrate velocity

TABLE 1

Print Gap vs. Substrate Velocity

| Print Gap | Substrate Velocity (inches/sec.) | | | | |
|---|---|---|---|---|---|
| (inches) | 20 | 40 | 60 | 80 | 100 |
| 0.050 | H | H | H | H | H |
| 0.100 | H | H | H | H | L |
| 0.150 | H | H | H | L | |
| 0.200 | H | H | H | | |
| 0.250 | H | L | L | | |
| 0.300 | H | | | | |
| 0.350 | H | | | | |

H = High Print Quality
L = Less Desirable Print Quality

It will thus be seen that the objects set forth above, among those made apparent from the preceding description, are efficiently attained and, since certain changes may be made in the above constructions and methods, without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A fluid jetting head, comprising:

a front having at least one orifice constructed to have fluid jetted through the orifice;

the front having a convex bulge at its outer surface and the orifice being located through the bulge, the bulge constructed in a smooth airfoil shape to promote laminar flow of air over the bulge.

2. The head of claim 1, wherein the orifice is located at the outermost end of the bulge.

3. The head of claim 1, wherein the bulge has an upstream slope descending on one side from the end of the bulge and a downstream slope descending from an opposite side of the end, and the upstream slope of the bulge forms an angle $\theta_u$ and the downstream slope forms an angle $\theta_d$ with a plane normal to the end of the bulge wherein $\theta_u$ and $\theta_d$ are less than about 45°.

4. The head of claim 3, wherein $\theta_u$ is about 30° to 5° and $\theta_u$ is larger than $\theta_d$.

5. The head of claim 3, wherein the head is constructed with a plurality of orifices to serve as an ink jet print head, the orifices having an inner diameter from about 0.0013 to about 0.024 inches and a pitch of about 0.004 to 0.0015 inches.

6. A printing system, comprising:

a track constructed to transport substrates to be printed at a printing location defining a printing location plane;

a print head having a front printing side having an orifice therethrough, the print head constructed to jet fluid through the orifice onto the substrates as they are transported to the printing location;

the front side having a convex bulge with an orifice substantially at the top of the bulge and two slopes, an upstream slope and a downstream slope, descending in opposite directions from the top of the bulge, the orifice defining an orifice plane normal to the direction fluid will jet through the orifice, the orifice plane and the printing location plane being separated by a print gap;

an air flow opening, and a blower constructed to blow air through the opening, located further from the printing location plane than the orifice plane, the air flow opening constructed to blow air onto the upstream slope, in a direction towards the orifice and the downstream slope.

7. The system of claim 6, including a vacuum port located on the downstream side of the bulge, farther from the printing location plane than the orifice plane, constructed to suck in air blown over the orifice.

8. The system of claim 6, wherein the blower, opening, relationship of the bulge to the print gap and the upstream and downstream slope of the bulge are constructed and arranged to promote laminar airflow up the upstream slope, through the print gap and down the downstream slope.

9. The system of claim 6, wherein the bulge has an upstream slope descending on one side from the end of the bulge and a downstream slope descending from an opposite side of the end, and the upstream slope of the bulge forms an angle $\theta_u$ and the downstream slope forms an angle $\theta_d$ with a plane normal to the end of the bulge, wherein $\theta_d$ and $\theta_u$ are less than about 45°.

10. The system of claim 9, wherein $\theta_u > \theta_d$ and $\theta_u$ equals about 30° to 5°.

11. The system of claim 9, wherein $\theta_d$ is substantially equal to $\theta_u$.

12. The system of claim 9, wherein $\theta_u$ is greater than $\theta_d$.

13. The system of claim 9, wherein $\theta_u$ is about 10° to 20°.

14. The system of claim 6, wherein the print gap is less than about 0.005 inches.

15. The system of claim 6, including a spacer extending towards the print head from a plate holding the substrate in the printing location, the spacer extending across the printing location plane to the print head side of the orifice plane.

16. The system of claim 15, wherein the plate includes an air relief opening substantially at the printing location.

17. A method of printing comprising:

providing a print head having at least one orifice located on a convex bulge on the face of the print head;

positioning the orifice in close registration with a substrate to be printed;

blowing air over the bulge, between the orifice and the substrate.

18. The method of claim 17, wherein the flow of air over the bulge is laminar.

19. The method of claim 17, wherein the substrate is transported past the orifice at substantially the speed of air flowing past the orifice.

20. The method of claim 17, wherein substrates are moved past the print head at over about 20 inches per second.

21. The method of claim 18, wherein the bulge is a ridge having a plurality of orifices at the top thereof and air is blown from a low point on the ridge, over the orifices and the slope of the ridge and velocity of air is such that the velocity gradient is not great enough to cause separation between the flowing air and ridge.

22. The method of claim 17, wherein the air is blown through a slot defined by the bulge and the substrate, where L equals the length of the slot, h is the gap between the print head and the substrate, $\mu$ is the viscosity of air and $\Delta p$ is the pressure differential causing the air to move, and the velocity of the air through the slot, V is about equal to $L\Delta p/12\,\mu h^2$.

23. The method of claim 17, wherein the air flow is effective for keeping dust and debris away from the orifice during printing sessions of over 10,000 substrates.

* * * * *